US008162156B1

(12) United States Patent
Crisman

(10) Patent No.: US 8,162,156 B1
(45) Date of Patent: Apr. 24, 2012

(54) IMPLEMENT HOLDER AND METHODS OF USE

(76) Inventor: Bruce Crisman, Wheatridge, CO (US)

( * ) Notice: Subject to any disclaimer, the term of this patent is extended or adjusted under 35 U.S.C. 154(b) by 352 days.

(21) Appl. No.: 12/494,137

(22) Filed: Jun. 29, 2009

(51) Int. Cl.
*A47F 7/00* (2006.01)

(52) U.S. Cl. ..... 211/85.6; 211/10; 211/70.7

(58) Field of Classification Search ..... 211/85.6, 211/70.2, 70.8, 60.1, 68, 69.1, 85.13, 70.7, 211/10, 11, 85.4, 41.1, 40, 41.14, 41.18, 211/50, 42, 70.6, 62, 63, 65, 66; 206/553, 206/564, 483, 371, 366
See application file for complete search history.

(56) References Cited

U.S. PATENT DOCUMENTS

| | | | | |
|---|---|---|---|---|
| 2,591,805 | A * | 4/1952 | Gossett | 211/89.01 |
| 3,285,768 | A * | 11/1966 | Habib | 428/160 |
| 3,487,947 | A * | 1/1970 | Bogar, Jr. | 211/70.8 |
| 3,696,920 | A | 10/1972 | Lahay | |
| 3,819,039 | A * | 6/1974 | Erickson | 206/388 |
| 3,915,213 | A * | 10/1975 | Graham, Jr. | 206/553 |
| 4,176,752 | A * | 12/1979 | Taber | 211/120 |
| 4,243,140 | A * | 1/1981 | Thrun | 206/380 |
| D271,903 | S | 12/1983 | Kaufman | |
| 4,485,919 | A * | 12/1984 | Sandel | 206/370 |
| 4,507,330 | A * | 3/1985 | Schaaf | 427/98.5 |
| 4,971,271 | A | 11/1990 | Sularz | |
| 5,005,710 | A * | 4/1991 | Hofer | 211/70.6 |
| 5,447,243 | A * | 9/1995 | Graber | 211/69.5 |
| 5,458,303 | A | 10/1995 | Ruckwardt | |
| 5,487,475 | A * | 1/1996 | Knee | 211/70.8 |
| 5,520,292 | A * | 5/1996 | Lombardi | 211/85.6 |
| D378,408 | S * | 3/1997 | Pyeatt et al. | D24/128 |
| D389,356 | S | 1/1998 | Calabrese | |
| 5,738,216 | A * | 4/1998 | Warner | 206/523 |
| 6,092,675 | A * | 7/2000 | Ramirez et al. | 211/68 |
| D445,287 | S * | 7/2001 | Kujala | D6/629 |
| 6,575,311 | B1 * | 6/2003 | Fink | 211/70.2 |
| 6,607,084 | B1 * | 8/2003 | Spinelli | 211/71.01 |
| 6,629,615 | B2 * | 10/2003 | Kim | 211/85.13 |
| D488,054 | S | 4/2004 | Myers | |
| 6,969,548 | B1 * | 11/2005 | Goldfine | 428/159 |
| D555,461 | S | 11/2007 | Tincher | |
| 7,303,568 | B2 * | 12/2007 | Jannot | 606/148 |
| D568,723 | S | 5/2008 | Morgan | |
| 2002/0104811 | A1 * | 8/2002 | Young et al. | 211/13.1 |
| 2002/0108918 | A1 * | 8/2002 | Pyle | 211/85.6 |
| 2002/0195366 | A1 * | 12/2002 | Castleberry | 206/423 |
| 2003/0132352 | A1 | 7/2003 | Weaver | |
| 2005/0035131 | A1 | 2/2005 | Martinson | |
| 2005/0077436 | A1 | 4/2005 | Nelson | |
| 2006/0076254 | A1 * | 4/2006 | Corbitt et al. | 206/370 |
| 2006/0113432 | A1 | 6/2006 | Driskell | |
| 2006/0237597 | A1 | 10/2006 | D'Andria | |
| 2007/0144331 | A1 | 6/2007 | Briggs et al. | |
| 2007/0235597 | A1 | 10/2007 | Winchester | |
| 2009/0101604 | A1 * | 4/2009 | Restis et al. | 211/41.2 |

* cited by examiner

*Primary Examiner* — Jennifer E. Novosad
(74) *Attorney, Agent, or Firm* — Albert Haegele; Leyendecker & Lemire, LLC

(57) ABSTRACT

An implement holder adapted to hold implements having slender, elongate handles is described. Embodiments of the implement holder comprise resilient foam in which slots for holding slender implements reside. Various embodiments are adapted to hold dental instruments, percussion implements such as drumsticks, mallets, and brushes, and artist implements such as pens, pencils, and paint brushes.

11 Claims, 4 Drawing Sheets

IMPLEMENT HOLDER AND METHODS OF USE

FIELD OF THE INVENTION

The present invention relates generally to holders for multiple drumsticks, mallets, wands, or similar items comprising relatively slender, elongate handles.

BACKGROUND

Percussionists typically use multiple percussion implements for playing their drums and other percussion instruments. Percussion implements include drumsticks, hammers, mallets, brushes, and other striking implements used to strike percussion instruments. Percussion implements also include rattles and shakers. Percussionists frequently use numerous different percussion implements during a performance or session, and sometimes change implements multiple times during a single song. For instance, a percussionist might start a song using a pair of ordinary drumsticks, switch to brushes for part of the song, and then change back to drumsticks. Moreover, percussionists sometimes break percussion implements while playing, requiring a percussionist to substitute a broken implement during a performance or session with one that is intact. Multiple percussion implements may also be required where a percussionist plays multiple percussion instruments during a single song, session, or performance.

Use of multiple implements and substitution of broken implements makes it advantageous to have ready access to a collection of percussion implements, and to perform relatively rapid exchange of one percussion implement or set of percussion implements for another (sets of percussion implements typically, but not necessarily, being a pair). Storage of percussion implements that are not being used but have recently been, or soon will be, is also required.

Accordingly, percussionists often place percussion implements near their instruments, on a table or similar horizontal surface, or in a holster, while the percussion implements are not being used; retrieving and returning percussion implements from and to proximate storage presents a percussionist with difficulties. Percussion implements are prone to colliding with each other while being placed in storage, creating unwanted noise, and percussion implements placed on a horizontal surface are prone to rolling off an edge. Percussionists can be substantially distracted from playing their instruments by having to carefully attend to retrieving and returning percussion implements in order to minimize implements noisily colliding or rolling off an edge of a horizontal surface. Retrieving a desired percussion implement from among multiple implements can also require a level of attention that distracts percussionists from their playing.

DETAILED DESCRIPTION

Figure 1:
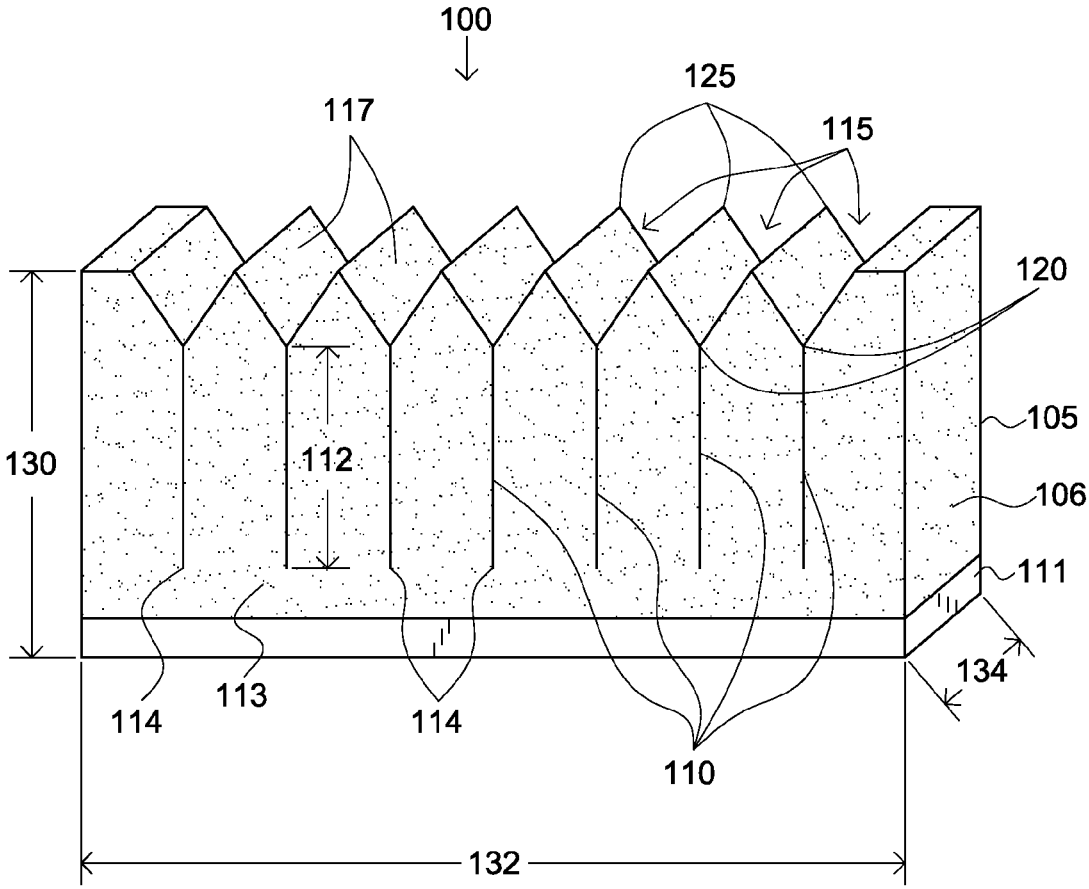
FIG. 1 is a perspective view of an implement holder according to one embodiment of the present invention.

Embodiments of the present invention include an implement holder adapted to securely hold drumsticks or other percussion implements having relatively slender, elongate handles. Embodiments of implement holders typically comprise blocks or masses of resilient foam having a plurality of holding slots in which percussion implements are readily placed. Each holding slot typically resides generally in a single plane. After placement, the percussion implements are held relatively securely, and are readily removed therefrom as well.

Variations of holding slots are adapted to facile guidance of percussion implements into the holding slots. Accordingly, a user may relatively carelessly position the percussion implement for placement in the implement holder, and the percussion implement will nevertheless slide into the holding slot with minimal guidance from the user. Once in the holding slot, a percussion implement is held relatively securely, and will not fall out unless physically dislodged from the slot. On the other hand, a user may readily remove the percussion implement from the slot by grasping the percussion implement and lifting it up through the holding slot until the percussion implement is free of the resilient foam.

By enabling facile placement of percussion implements in an implement holder with only nominal attention required by the user, embodiments of the present invention permit a percussionist to quickly and readily store or retrieve percussion implements with minimal distraction from his or her playing. Indeed, with knowledge of the location of the implement holder, a user may successfully place percussion implements in the implement holder a vast majority of the time without looking at the holder. At most, a quick glance is sufficient verification of implement holder location to enable successful placement of a percussion implement in the implement holder.

The implement holder furthermore facilitates relatively quiet storage and retrieval of percussion implements. Percussion implements are prevented from rolling and colliding with each other while stored in an implement holder, and the percussion implements make little or no sound when they contact the soft foam of the implement holder.

Embodiments of the implement holder enable users other than percussionists to place other slender items in the implement holders with minimal guidance and minimal attention. For instance, dental health care professionals such as dentists and dental hygienists often use a multitude of dental implements having slender, elongate handles, and frequently change implements during a procedure. Embodiments of the implement holder enable a dental health care professional to securely store dental implements immediately proximate a patient, and to readily exchange implements while paying little attention to placement of implements in the implement holder. The dental health care professional therefore suffers little distraction from the important task at hand, that of treating the patient, when changing or exchanging dental implements. Moreover, dental implements can reside in the implement holder without having their ends contaminated by touching a surface.

Artists may also securely store slender handled art implements, such as paint brushes, pens, and pencils, immediately proximate a canvas or other painting substrate. Embodiments of the implement holder enable an artist to readily change implements while paying little attention to placement brushes in the implement holder.

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct connection between the identified elements, components, or objects. Often the manner of the coupling will be related specifically to the manner in which the two coupled elements interact.

The term "approximately," as used in this specification and appended claims, refers to plus or minus 10% of the value given.

The term "about," as used in this specification and appended claims, refers to plus or minus 20% of the value given.

The term "uniformly narrow," as used in this specification and appended claims, refers to properties of a holding slot, the properties including that the holding slot has a gap of an inch or less when empty, and the holding slot has slot walls that are substantially parallel or converge as the slot walls approach an inner terminus of the holding slot. Substantially parallel slot walls can have minor irregularities and undulations, particularly where a very flexible resilient foam is used, such that the slot walls are not strictly parallel at all points, but are, on average, approximately parallel.

The term "resilient foam," as used in this specification and appended claims, refers to flexible or elastic foam material that tends to return to its original shape after being compressed, bent, or stretched. Examples of resilient foam include, but are not limited to, foam material such as is used in furniture cushions, automobile seats, and carpet underlayment, flexible low density polyurethane foam, foam rubber, polyvinyl chloride plastic foam, and polyethylene foam. Resilient foam may be open cell or closed cell foam.

The term "percussion implement," as used in this specification and appended claims, refers to devices used to play percussion instruments by hitting, tapping, or otherwise striking the percussion instruments. Percussion implements include, but are not limited to, drumsticks, brushes, mallets, hammers, shakers, and rattles. Some percussion implements are used to play percussion instruments such as drums, timbales, tympani, cymbals, marimbas, xylophones, and vibraphones, and some percussion implements, such as shakers and rattles, are percussion instruments in and of themselves.

A First Embodiment Implement Holder

Figure 2A:
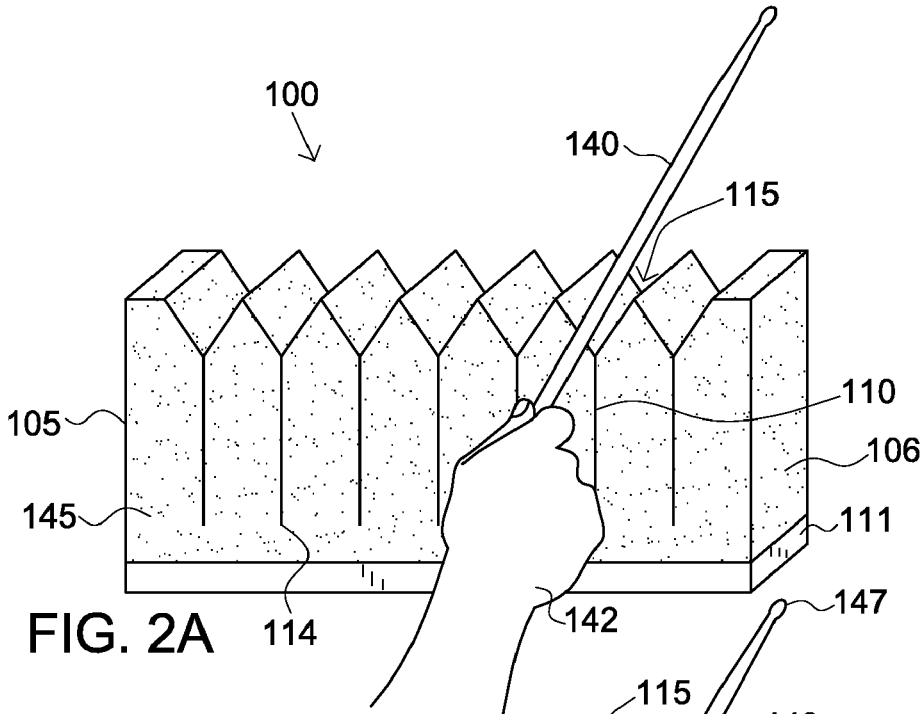
FIG. 2A is a perspective view of an implement holder according to one embodiment of the present invention.
Figure 2B:
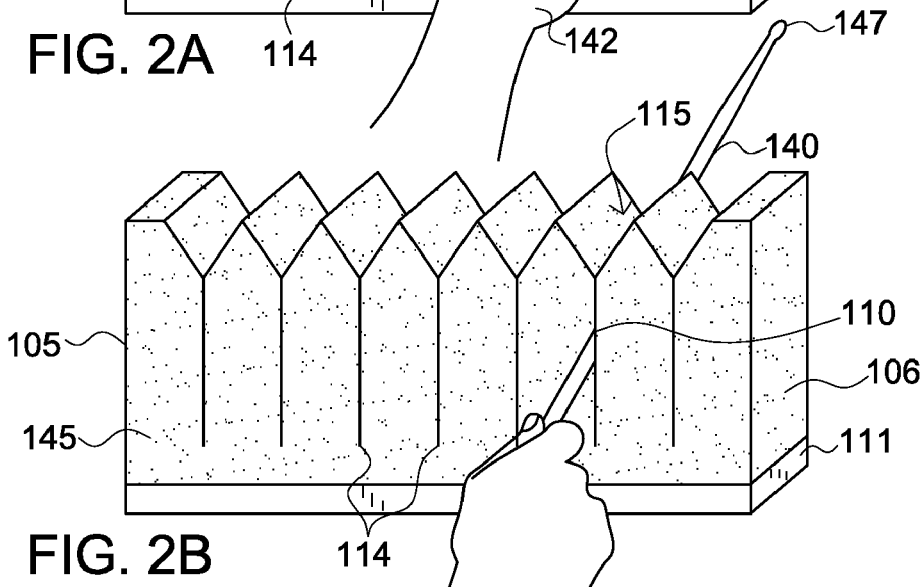
FIG. 2B is a perspective view of an implement holder according to one embodiment of the present invention.
Figure 2C:
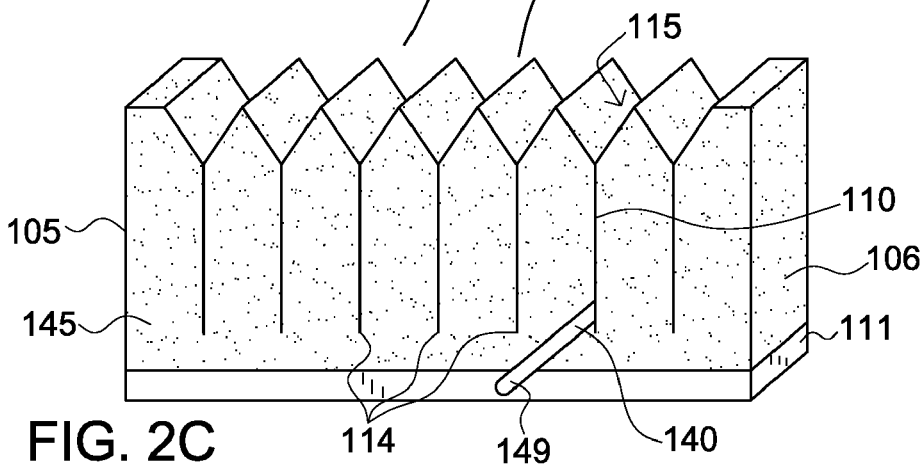
FIG. 2C is a perspective view of an implement holder according to one embodiment of the present invention.
Figure 3:
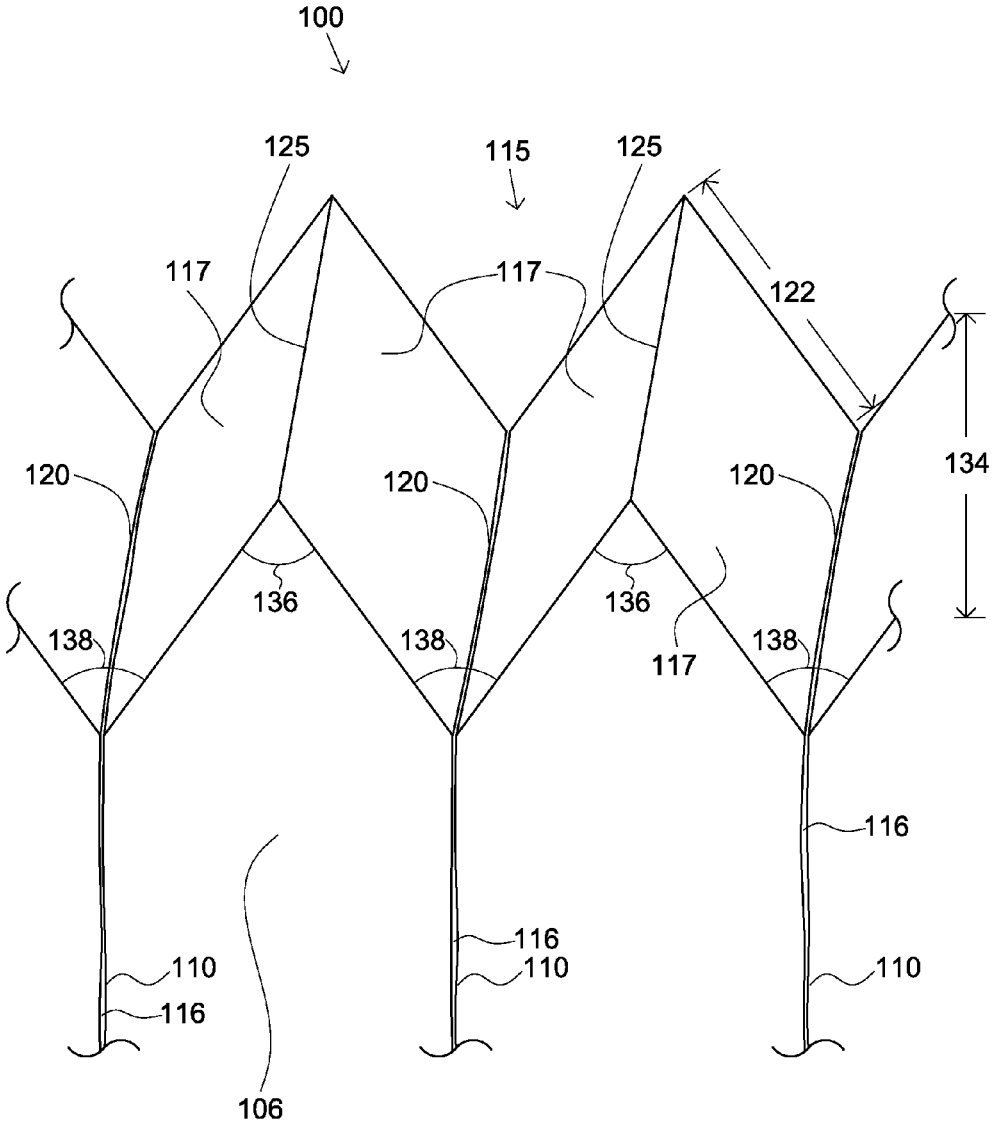
FIG. 3 is a perspective view of an implement holder according to one embodiment of the present invention.

A first embodiment implement holder 100 is illustrated in FIGS. 1-3. The first embodiment implement holder comprises a retention block 105. The retention block comprises a mass of resilient foam 106, in which resides a plurality of holding slots 110. The resilient foam is coupled to a substantially rigid base 111. The substantially rigid base of the first embodiment consists essentially of wood. Other substantially rigid bases include, but are not limited to, wood, rigid or semi-rigid plastic, rubber, or metal. The resilient foam of the first embodiment implement holder comprises flexible low density polyurethane foam, which has desirable friction characteristics such that percussion implements such as drumsticks readily slide into the holding slots.

The holding slots 110 are created in the mass of resilient foam 106 by slicing, severing, melting, cutting, sawing, or otherwise dividing the resilient foam while removing little or no foam material. In some variations, multiple pieces of resilient foam are coupled together such that a resulting mass of resilient foam comprises holding slots at seams where the multiple pieces of resilient foam meet. The holding slots of the first embodiment are therefore substantially uniformly narrow, with slot walls generally touching each other or being separated by gaps 116 of less than a ¼ inch when the holding slots are empty. The gaps are best illustrated in FIG. 3. Such small gaps are well adapted to holding marimba mallets, which typically have very slender handles having diameters approximating diameters of chopsticks. Variations of holding slots have gaps between slot walls that are preferably less than 1 inch, more preferably less than ½ inch, and most preferably less than ¼ inch, when empty. A person of ordinary skill in the art recognizes that placing a drumstick or other percussion implement in a holding slot can have an effect of pushing the slot walls of the holding slot apart, thereby increasing the holding slot gap beyond its size while empty.

The holding slots 110 terminate within the retention block 105 at an inner terminus 114. As illustrated in FIG. 1, the holding slots when empty are uniformly narrow. In some embodiments, the empty holding slot walls converge as they approach the inner terminus. Empty holding slots do not become wider or enlarged as they extend from the periphery to the inner terminus, and the holding slots are not wider or enlarged at or proximate the inner terminus; such configuration could undermine holding a percussion implement securely.

The implement holder 100 further comprises valleys 115, each of the valleys having valley walls 117 and a valley nadir 120. The valley nadir is the point or region at which the valley reaches its greatest penetration into the resilient foam. The holding slot 110 meets the valley at the valley nadir. The holding slot therefore terminates at the valley nadir. The implement holder further comprises inter-slot maxima 125, each of the inter-slot maxima residing between adjacent valleys. The valleys and the inter-slot maxima reside along a side of the retention block, the side residing at a periphery of the mass of resilient foam 106. In the first embodiment implement holder, the side of the resilient foam is a top side, as shown in FIG. 1.

The valley walls 117 of the first embodiment implement holder 100 are generally planar. Accordingly, both the inter-slot maxima 125 and valleys 115 comprise dihedrals, as shown in FIG. 1. The first embodiment implement holder comprises seven holding slots 110, seven valleys 115, and six inter-slot maxima 125, each of the inter-slot maxima comprising peaks formed by adjacent valleys. In other embodiments, the valley walls may be curved.

As best illustrated in FIG. 1, a height dimension 130 of the retention block 105 is approximately 11.0 inches, a length dimension 132 of the retention block is approximately 18.0 inches, and a width dimension 134 of the retention block is approximately 4.0 inches. The holding slots 110 have a holding slot height 112 of approximately 6.5 inches. The holding slot height is a distance the holding slot extends away from the valley nadir 120 into the resilient foam. Moreover, each of the holding slots resides generally in a single plane, and extends the entire approximately 4.0 inches of the width dimension of the retention block, from a first side of the retention block 113 to a second side of the retention block. The second side is not visible in FIG. 1 because it faces away from the viewer; the first side and second side are opposite sides of the retention block. Other embodiments comprise retention blocks having height dimensions, length dimensions, and width dimensions that vary from the retention block dimensions of the first embodiment. In one embodiment of the implement holder that performed well as a percussion implement holder, the width dimension was approximately three inches.

Variations of implement holders in which holding slots have holding slot heights of at least 2 inches are well adapted to holding percussion implements. Accordingly, implement holders for percussion implements have holding slot heights of equal to or greater than about two inches, more preferably between two inches and ten inches, and most preferably about 6.5 inches.

FIGS. 2A-2C illustrate a typical use of the first embodiment implement holder 100. As illustrated in FIG. 2A, a percussion implement 140 resides in a user's hand 142. The percussion implement illustrated in FIGS. 2A-2C is a drumstick. The user grasps the drumstick and initiates deposition of the drumstick in the implement holder by positioning the drumstick proximate a holding slot 110 with a portion of the drumstick residing in a valley 115.

Precise positioning is not required because the valley 115 is adapted to guide the drumstick 140 toward the holding slot 110, the drumstick tending to slide down a valley wall 117 until it encounters a holding slot 120. Continued downward pressure by the user causes the drumstick to slide into the holding slot. FIG. 2B illustrates the drumstick 140 residing in the holding slot 110, the drumstick having been pushed into the holding slot by downward pressure from the user.

The drumstick 140 is illustrated in FIG. 2B with its handle end (not shown, obscured by the user's hand 142) extending out of the holding slot 110 on a user side 145 of the retention block 105, and its drumstick head end 147 extending out of the holding slot on an opposing side (not visible). The user side and opposing side of the implement holder are defined relative to the user, with the user side approximately facing toward the user, and the opposing side facing away from the user.

As illustrated in FIG. 2C, the drumstick 140 has been deposited in a lower portion of the holding slot 140, where the drumstick resides securely held until the user removes it. The handle end 149 of the drumstick is seen extending from the holding slot on the user side 145 of the retention block 105. The drumstick head end extends from the holding slot on the opposing side of the retention block, but is not visible in FIG. 3C.

Placement of the drumstick 140 in the implement holder 100, as illustrated in FIGS. 2A-2C, can be accomplished without the user watching the drumstick as it encounters the implement holder. In other words, the user can deposit the drumstick in the implement holder without looking.

Of course, the implement holder must be approximately properly located and oriented, and the user must be aware of the implement holder's general location and orientation, in order for the user to place a percussion implement or similar implement in the implement holder without looking. Moreover, a user might quickly glance at the implement holder prior to or during placement of a percussion implement in the implement holder, in order to confirm the implement holder's general location and orientation. However, very little attention or care is required for a user to deposit a percussion implement or similar item in a secure but easily accessible place in the implement holder. The lack of attention or care required is due, at least in part, to the first embodiment implement holder's design, with peaks residing between the holding slots 110, and valleys 115 having valley walls 117 that slope downwardly toward the holding slots.

As best illustrated in FIG. 3, each valley side 117 of the first embodiment implement holder 100 has a valley side length dimension 122 of approximately 2.0 inches. In addition, each valley side is approximately 4.0 inches wide, which is consistent with the width dimension 134 of the retention block being approximately 4.0 inches. As best illustrated in FIG. 3, peak angles 136 of the first embodiment are approximately 60° and valley angles 138 are approximately 60°. Accordingly, distances of approximately 2.0 inches separate adjacent inter-slot maxima 125, which in the first embodiment implement holder are peaks. Approximately 2.0 inches also separates adjacent holding slots 110. For the purposes of this specification and appended claims, peak angles and valley angles are always less than 180°.

Variations of implement holders were tested for efficacy of placement of drumsticks without looking, and the first embodiment implement holder outperformed other embodiments. A test comprising 106 "no-look" attempts to place a drumstick in the first embodiment implement holder resulted in successful placement of the drumstick 101 times, with 5 misses, a 95% success rate.

In one implement holder variation, holding slots disposed in adjacent positions in a retention block are separated by approximately 2.5 inches, and a top surface of the retention block is substantially flat, such that valleys do not exist, and inter-slot maxima are planar regions that are level with upper end of the holding slots. Like the first embodiment implement holder, the one implement holder variation comprises low density flexible polyurethane foam and has a width dimension of approximately 4.0 inches. A test in which 106 "no-look" attempts to place a drumstick in the one variation of an implement holder were performed resulted in successful placement of the drumstick 35 times, with 71 misses, a 33% success rate.

In another implement holder variation, adjacent holding slots are separated by approximately 2.5 inches, inter-slot maxima comprise peaks having peak angles of approximately 113°, and valleys have valley angles that are also approximately 113°. Accordingly, valley sides of the another implement holder variation have a length dimension of approximately 1.5 inches. Like the first embodiment implement holder, the another implement holder variation comprises low density flexible polyurethane foam and has a width dimension of approximately 4.0 inches. A test in which 106 "no-look" attempts to place a drumstick in the another implement holder variation were performed resulted in successful placement of the drumstick 81 times, with 25 misses, a 76% success rate.

The tests described above show that decreased peak angle is associated with greater success in placing drumsticks in implement holders. As peak angles grow smaller however, holding slots necessarily become closer together for a given valley side length dimension. Adjacent holding slots being separated by approximately 2.0 inches is an advantageous, if not optimal, configuration for holding percussion implements. This configuration facilitates easy retrieval of stored implements and, combined with approximately 60° peak angles and valley angles, also enables facile placement of percussion implements in the implement holder.

For an implement holder adapted to hold percussion implements, peak angles and valley angles are preferably between 113° and 30°, more preferably between 90° and 45°, and most preferably about 60°.

A Second Embodiment Implement Holder

Figure 4:
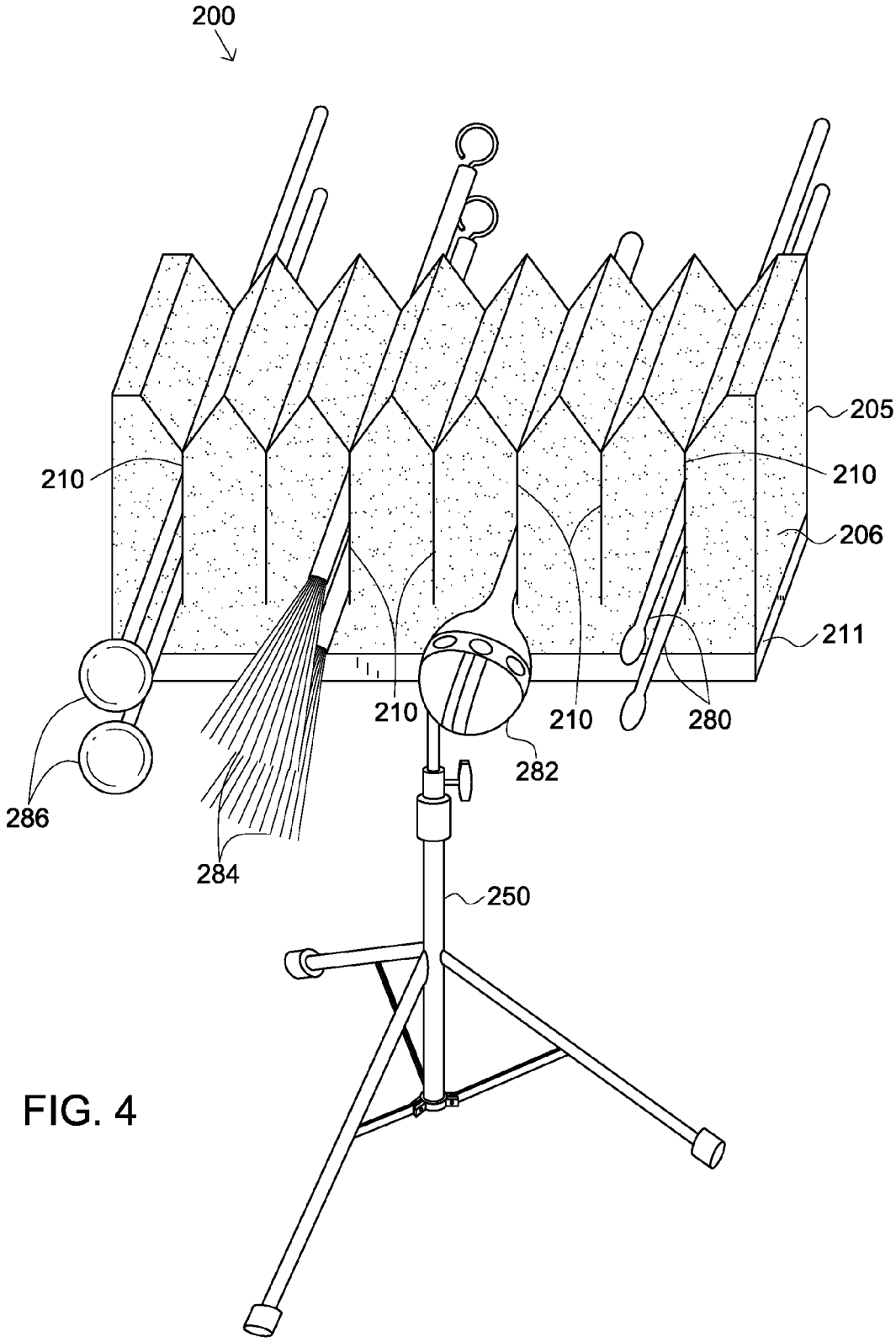
FIG. 4 is a perspective view of an implement holder according to one embodiment of the present invention.

A second embodiment implement holder 200 is illustrated in FIG. 4. The second embodiment implement holder comprises a retention block 205 similar, if not identical to, the retention block of the first embodiment implement holder. Thus the retention block of the second embodiment comprises holding slots 210 residing in resilient foam, the resilient foam being affixed to a substantially rigid base 211. The second embodiment implement holder further comprises a stand 250. As illustrated in FIG. 4, the retention block is disposed with a bottom surface of the retention block residing in a horizontal plane, but the stand is adapted to hold the retention block at various orientations, including orientations in which no axis of the bottom surface of the retention block resides in a horizontal plane. The stand is also adapted to support the implement holder at various heights above a supporting surface. A typical supporting surface is a floor. Other supporting surfaces include, but are not limited to, the ground, or a paved surface such as a street or sidewalk. The stand of the second embodiment implement holder is a normal cymbal stand modified to securely hold and support the implement holder. The stand is adapted to support the retention block in a range between about 18 inches and about 40 inches above the supporting surface, and to support the retention block at various orientations or angles relative to the supporting surface.

As illustrated in FIG. 4, several percussion implements reside within holding slots 210, the several percussion implements including drumsticks 280, a shaker rattle 282, brushes 284, and marimba mallets 286.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For example, some embodiments of implement holders are adapted to holding artists paint brushes. A variation of such an implement holder comprises a retention block having a length dimension of approximately 10 inches, a height dimension of approximately 4.0 inches, and a width dimension of approximately 1.5 inches. The retention block comprises flexible low density polyurethane foam in which eight holding slots reside, adjacent holding slots being separated by approximately 1.0 inch.

Another example of an alternative embodiment of an implement holder comprises multiple pieces of resilient foam that are coupled together. The multiple pieces of resilient foam can be coupled together by affixing each of the multiple pieces of resilient foam to the same substantially rigid base. Where multiple pieces of resilient foam are coupled together, a mass of resilient foam results.

I claim:

1. An implement holder including a mass of resilient foam, the mass of resilient foam comprising:
- a periphery;
- a plurality of valleys, each of the plurality of valleys comprising a valley nadir, and;
- a plurality of holding slots, each of the plurality of holding slots:
  - comprising a substantially planar slot in the mass of resilient foam;
  - extending from the periphery into the mass of resilient foam 1 inch or more and terminating at an inner terminus;
  - being uniformly narrow;
  - intersecting the periphery at the valley nadir; and
- an inter-slot maximum residing between two of the plurality of valleys, the inter-slot maximum including a peak for guiding an implement into one or more of the plurality of holding slots, wherein the each of the valleys comprises a substantially planar valley side, the substantially planar valley side extending from the valley nadir to the inter-slot maximum.

2. The implement holder of claim 1, wherein the peak comprises a peak angle, the peak angle having a peak angle value within in a range of about 113° to about 30°.

3. An implement holder combination comprising:
- the implement holder of claim 2 and
- a percussion implement, a portion of the percussion implement residing in at least one of the plurality of holding slots.

4. A method of using an implement holder comprising:
- providing the implement holder of claim 2;
- placing a slender implement in the holding slot.

5. The method of using an implement holder of claim 4, wherein the slender implement is one of a percussion implement, an art implement, or a dental implement.

6. The implement holder of claim 1, wherein the each of the plurality of valleys further comprises a valley angle, the valley angle having a valley angle value within in a range of about 113° to about 30°.

7. The implement holder of claim 6, wherein the peak angle value and the valley angle value are approximately equal.

8. The implement holder of claim 7, wherein the resilient foam is polyurethane foam.

9. The implement holder of claim 7, wherein the one or more of the plurality of holding slots extends from the periphery into the mass of resilient foam about 4.0 inches or more.

10. The implement holder of claim 9, wherein the peak angle value is within a range of about 90° to about 45°.

11. The implement holder of claim 10, wherein any adjacent two of the plurality of holding slots are separated by a distance of about 2.0 inches.

* * * * *